US005339617A

United States Patent [19]

Dammann

[11] Patent Number: 5,339,617

[45] Date of Patent: Aug. 23, 1994

[54] FALSE TWIST YARN CRIMPING APPARATUS

[75] Inventor: Peter Dammann, Remscheid, Fed. Rep. of Germany

[73] Assignee: Barmag AG, Remscheid, Fed. Rep. of Germany

[21] Appl. No.: 545,928

[22] Filed: Jun. 29, 1990

[30] Foreign Application Priority Data

Jul. 1, 1989 [DE] Fed. Rep. of Germany ..... 3921758
Nov. 15, 1989 [DE] Fed. Rep. of Germany ..... 3937975

[51] Int. Cl.[5] ..... D02G 1/02; D02J 13/00
[52] U.S. Cl. ..... 57/290
[58] Field of Search ..... 57/282, 283, 284, 287, 57/288, 289, 290, 291, 309; 28/249, 258

[56] References Cited

U.S. PATENT DOCUMENTS

| | | | |
|---|---|---|---|
| Re. 30,159 | 11/1979 | Kubler | 57/291 |
| 3,800,374 | 4/1974 | Ozawa | 28/257 |
| 3,969,800 | 4/1976 | Baldini et al. | 28/246 |
| 4,115,985 | 9/1978 | Venot | 57/286 |
| 4,236,323 | 12/1980 | Dammann et al. | 57/290 X |
| 4,242,862 | 1/1981 | Negishi | 57/287 |
| 4,567,721 | 2/1986 | Kuroda et al. | 57/284 |
| 4,809,494 | 3/1989 | Dammann | 57/291 |

FOREIGN PATENT DOCUMENTS

| | | | |
|---|---|---|---|
| 0332227 | 9/1989 | European Pat. Off. | 57/284 |
| 2501183 | 7/1975 | Fed. Rep. of Germany . | |
| 8024032 | 2/1982 | Fed. Rep. of Germany . | |
| 1192845 | 1/1988 | Japan | 57/284 |
| 63-315628 | 12/1988 | Japan . | |
| 63-315629 | 12/1988 | Japan . | |
| 1379284 | 1/1975 | United Kingdom | 57/284 |

OTHER PUBLICATIONS

T. Egambaram et al, "Heat Transfer in False-Twist Texturing", Textile Research Journal, Oct. 1974 pp. 803–812.

*Primary Examiner*—Daniel P. Stodola
*Attorney, Agent, or Firm*—Bell, Seltzer, Park & Gibson

[57] ABSTRACT

An elongate and arcuately curved yarn heating plate of the type adapted for use in a false twist yarn crimping machine which utilizes a specific relationship between the curvature of the heating plate and the heat imparted to the yarn so as to permit the length of the heating plate to be shortened as compared to conventional lengths. More particularly, the present invention involves the shortening of the radius of curvature of the heating plate from known and accepted values, which has been found to permit the length of the heating plate to be shortened while still providing adequate heat transfer to the yarn.

10 Claims, 3 Drawing Sheets

FALSE TWIST YARN CRIMPING APPARATUS

BACKGROUND OF THE INVENTION

The present invention relates to a false twist yarn crimping machine of the type disclosed in Kubler U.S. Pat. No. Re. 30,159.

In the design and construction of the known false twist yarn crimping machines, it has been assumed that increasing yarn speeds and higher yarn deniers require longer heaters, so as to insure that the advancing yarn is heated to the desired or "target" temperature. Increasing the length of the heaters is undesirable in that it increases the overall size and expense of the machine.

It is an object of the present invention to provide a heating plate for a false twist yarn crimping machine which is able to impart the desired target temperature to the yarn, while operating at high yarn speeds, and wherein the length of the heater can be decreased from the heretofore assumed length.

SUMMARY OF THE INVENTION

The above and other objects and advantages of the present invention are achieved in the embodiment herein by the provision of a false twist yarn crimping machine which comprises yarn package mounting means, an elongate yarn heating plate, an elongate yarn cooling plate, yarn friction false twisting means, yarn take-up means, and yarn delivery means for advancing a yarn from a package on the mounting means and serially to the heating plate, the cooling plate, the false twisting means, and the take-up means. In accordance with the present invention, the heating plate has a radius of curvature R, and a length L measured between the ends of the heating plate. Also, L is between about 0.8 and 2.2 meters, and the ratio R/L is between about 0.8 and 4.6. Further, the heating plate has a looping angle alpha which is defined as the angle between a tangent at the entry end of the heating plate and a tangent at the exit end of the heating plate, and R approximately equals $$\frac{L}{2\cos(\text{alpha}/2)}.$$

The present invention disproves the accepted assumption that an increase of yarn speed and higher yarn denier will require an increased heater length, if the target temperature necessary for the false twist texturing process is to be reached with certainty. The invention is based on the discovery that by increasing the curvature of the heating plate (i.e. decreasing the radius of curvature), the target temperature can be reached with a decreased dwelling time, and therefore the length of the heating plate can be decreased.

German Utility Model G 80 24 032.0 teaches that the radius of a cooling plate may be reduced such that the quotient Q=R/L is smaller than 4. This measure is taken so as to suppress twist fluctuations. However simultaneously, a length of the cooling plate is suggested, which is adapted to the dwelling times, which are normally used for an adequate cooling.

It is further known from German OS 38 01 506 and corresponding U.S. Pat. No. 4,809,494 that the radius of a heating plate may be reduced to less than 10 meters, and to construct a heating plate having a radius of, for example, 7 meters. It has not been recognized, however, that a reduction in the radius of the heating plate may be accompanied by a reduction in its length as well, and such that a shortened heater offers particular advantages as noted herein.

BRIEF DESCRIPTION OF THE DRAWINGS

Some of the objects and advantages of the present having been stated, others will appear as the description proceeds, when taken in conjunction with the accompanying drawings, in which.

DETAILED DESCRIPTION OF THE PREFERRED EMBODIMENTS

Figure 1:
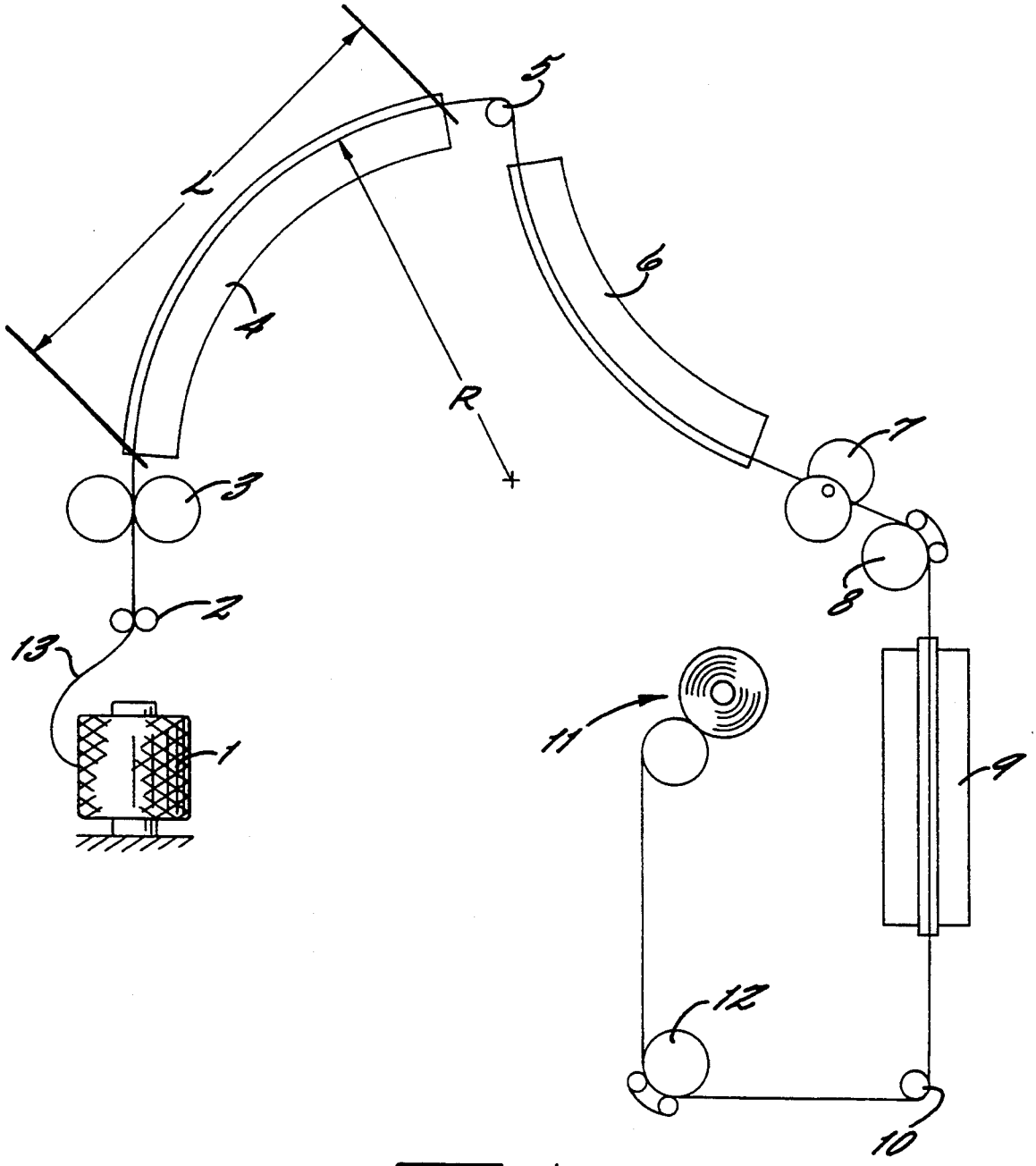
FIG. 1 is a schematic side elevation view of a false twist yarn crimping machine which embodies the features of the present invention.

Referring more particularly to the false yarn crimping machine as illustrated in FIG. 1, a synthetic yarn 13 is illustrated as being unwound from a feed package 1 and conveyed through a yarn guide 2 by means of a first feed system 3. The yarn is then guided over a curved heating plate 4, and deflected by a yarn guide 5 between the plate 4 and a subsequent curved cooling plate 6. Upon leaving the curved cooling plate 6, the yarn is false twisted by a conventional friction false twist unit 7. A second feed system 8 follows, which withdraws the yarn from the false twisting zone. Subsequently, the yarn may be reheated in a second heater 9, which is not a part of the present invention. After being deflected by a subsequent yarn guide 10, the yarn is withdrawn by a third feed system 12 from the second heater and finally wound into a package in a takeup unit 11.

The false twist yarn crimping machine may also serve to draw the yarn being processed. In particular, the delivery rolls 3 and 8 as shown in FIG. 1 may run with different speeds which are sufficient to effect drawing. The yarn on the package 1 may be a low oriented or pre-oriented yarn (LOY or POY), and by reason of the drawing, the denier of the yarn on the package is higher than the denier of the yarn as it is being false twisted. The ratio of the delivery speeds of the rollers 8 to the rollers 3 is typically less than 4:1 and higher than 1.05:1 depending on the type of yarn being processed (i.e., LOY or POY).

The heating plate 4 comprises an elongate curved plate having a groove extending along its length, and with the yarn traveling along the bottom of the groove. For purposes of providing good contact between a heating plate and yarn moving across it, it has heretofore been known to shape the heating plate arcuately. For the heating of the heating plate various means are available, such as, for example, resistance heaters or hot vapor systems, as are disclosed, for example, in German OS 23 48 371, with the threadline and heater being arranged relative to each other such that the yarn moves into and out of engagement with the heater substantially at points of tangency arcuately displaced along the plate.

An important feature of the present invention is that a radius of curvature R and a length L of the heating plate are optimally coordinated in such a manner that the desired temperature may be imparted to the yarn at the minimized length of the heating plate, the length L being measured as the chord of the arc separating the points of tangency on the plate. In one embodiment, the heating plate is circularly curved, so that it has only one radius.

Figure 4:
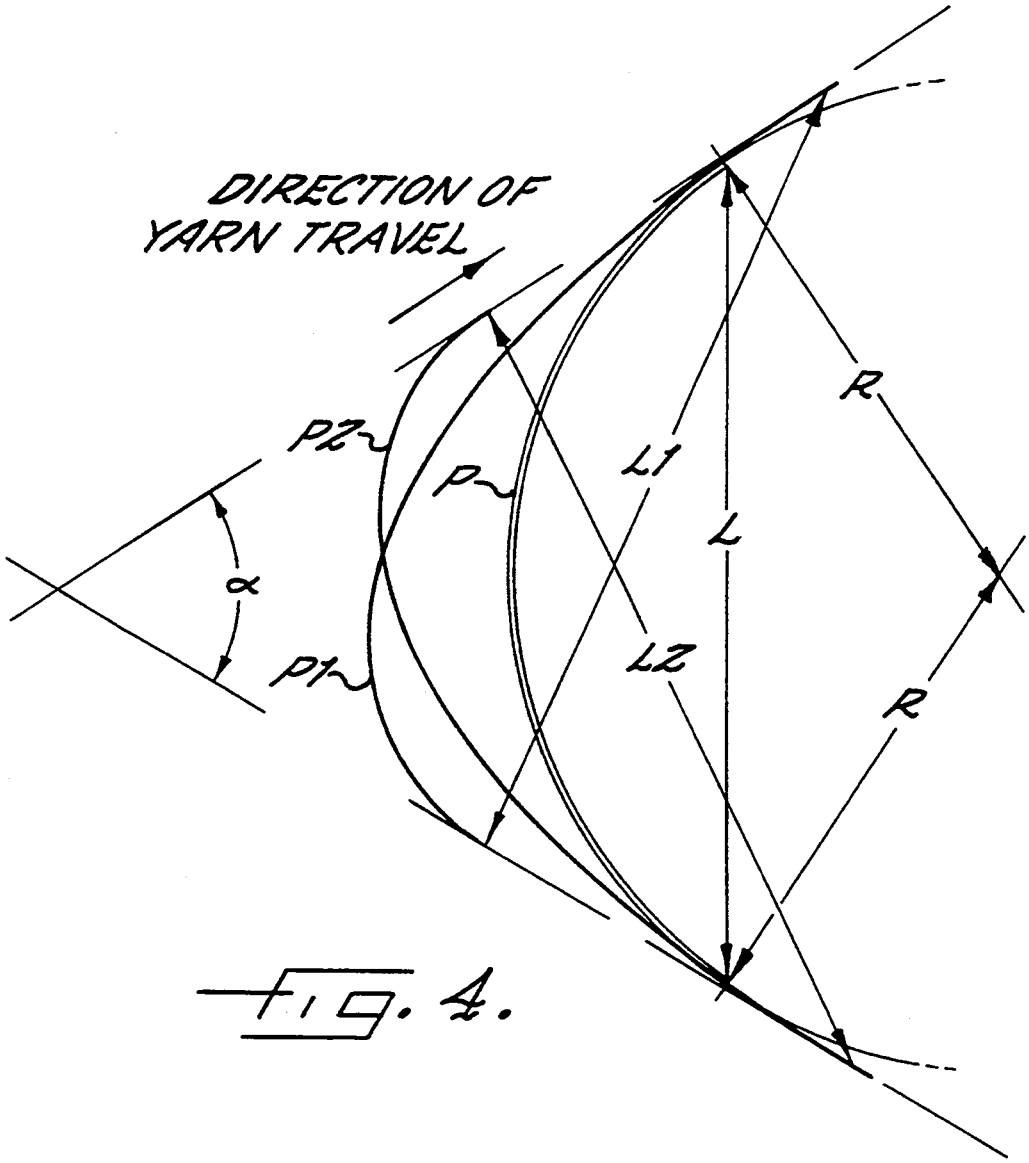
FIG. 4 is a schematic illustration of several possible curvatures of the heating plate of the present invention.

In the case of a heating plate of uniform radius along the entire length of the heating plate, the radius R may be determined by the formula R=

$$\frac{L}{2\cos(\text{alpha}/2)},$$

with alpha being the looping angle of the yarn on the heater and which is defined as the angle between a tangent at the entry end of the heating plate and a tangent at the exit end of the heating plate, note FIG. 4. However, it is also possible to provide the heating plate with a curvature which varies over the length thereof. In this instance, the radius of curvature over the length of the heater varies between a theoretical value approximately equaling $$\frac{L}{2\cos(\text{alpha}/2)},$$

and a value less than such theoretical value. As a result, it is accomplished that the association of length and looping angle of the yarn on the heating plate is within the limits which apply to the circular curvature.

It is the customary understanding that a curvature of the heating plate is necessary, in order to obtain a full contact of the yarn on the heating plate, but that the degree of the curvature is not significant for the heat transfer. While this understanding applies, in fact, to a flat or smooth untextured yarn, it surprisingly does not apply to a yarn advancing in a false twist zone. Here, a range of dependence exists, in which the curvature influences the heat transfer, and in which it is consequently possible to reduce the length of the heating plate.

However, there is a minimum length of the heating plate. This minimum length is dependent on the denier of the yarn. On the one hand, the minimum length ensures an adequate minimum dwelling time of the yarn on the hot plate. On the other hand, a great heater length with a small radius also includes a large angle of looping and, thus, a considerable increase of tension in the yarn. As a result of the limitation of the length of the heating plate, the looping angle and, thus, the increase of the tensile force are technically limited to ranges, which are given by the technology of false twist texturing. Thus for example, when processing a polyamide yarn (e.g. Nylon 6 or Nylon 6.6) having a denier of between about 15 to 44 dtex after false twist crimping and drawing thereof, the length L between the ends of the heating plate should preferably be between about 0.8 and 1.6 meters, and the ratio R/L should preferably be between about 0.8 and 4.4. When processing a polyester yarn having a denier between about 55 to 500 dtex after false twist crimping and drawing thereof, the length L should preferably be between about 1.6 and 2.2 meters, and the ratio R/L should preferably be between 0.8 and 3.2.

It will be possible to obtain the specified, small heater lengths only when the curvature of the heating plate is selected such that the specified quotients Q=R/L is satisfied. This means that a lower range of radii of curvature for the heating plate exists, in which the necessary heating plate length is only insignificantly influenced by the respective radius. In this range the necessary plate length is dependent substantially on the speed and the denier of the yarn. A necessary plate length as herein defined refers to a plate adequate to raise the temperature of the yarn substantially to the desired or target temperature. In the ideal case, i.e. with an ideal heat transfer, the desired temperature of the yarn corresponds to the actual temperature of the heating plate.

However, in the range of interest in the context of the present invention, the heating plate length is a function of the radius of the heater. This means: the smaller the radius, the smaller the length.

Beyond this range of interest there is a range of very small curvatures, in which the heating plate length is also dependent on the denier and on the speed of the yarn. In the past, this range has in general been resorted to in the design and construction of the heating plates in false twist crimping machines.

Figure 2:
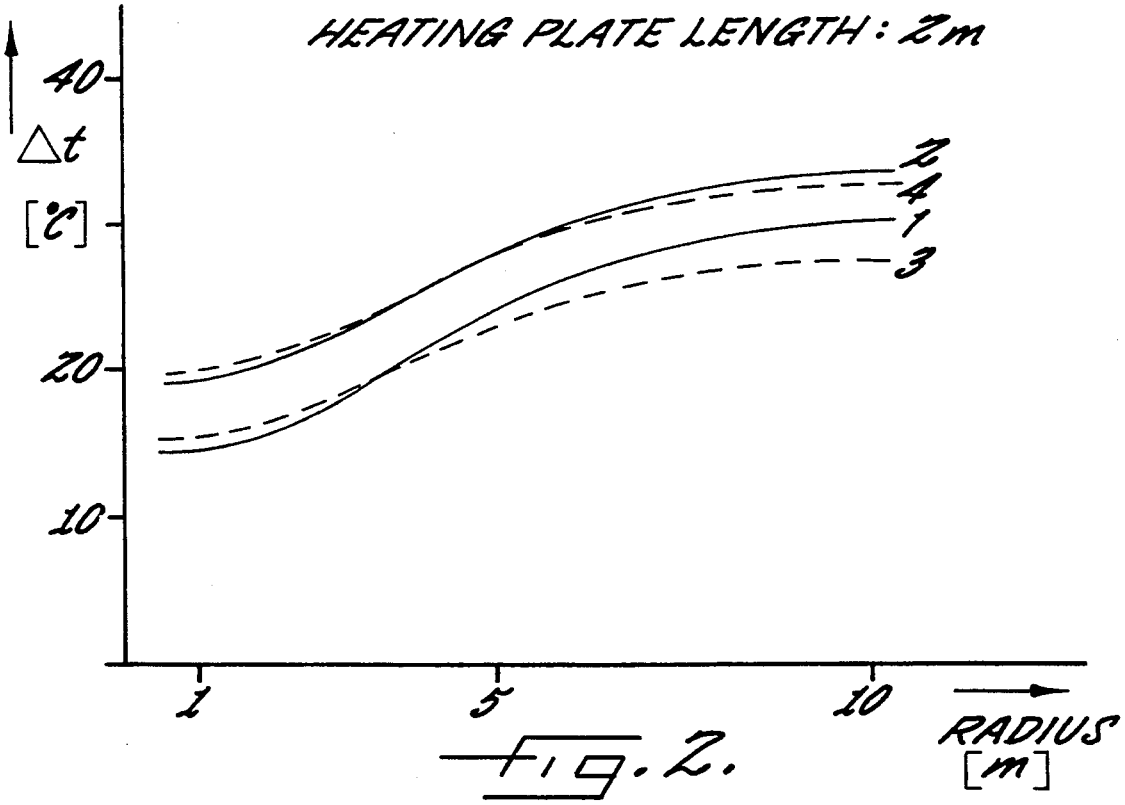
FIGS. 2 and 3 are diagrams showing the dependence of the temperature difference between the yarn temperature and the temperature of the heating plate, and the radius of the heating plate.

This relationship is illustrated in the diagram of FIG. 2. Plotted on the abscissa is the radius of a heating plate. The ordinate represents the temperature difference delta T, which exists between the set temperature of the heating plate and the temperature of the yarn leaving the plate. The testing is conducted on Curve 1: a PES yarn, 167f32 dtex, advancing at a speed of 800 m/min., and a heater temperature of 230°;

Curve 2: a PES yarn, 167f32 dtex, advancing at a speed of 800 m/min., and a heater temperature of 220°;

Curve 3: a PES yarn, 76f24 dtex, advancing at a speed of 1000 m/min., and a heater temperature set to 220° C.;

Curve 4: a PES yarn, 76f24 dtex, advancing at a speed of 1200 m/min., and a heater temperature set to 230° C.

Figure 3:
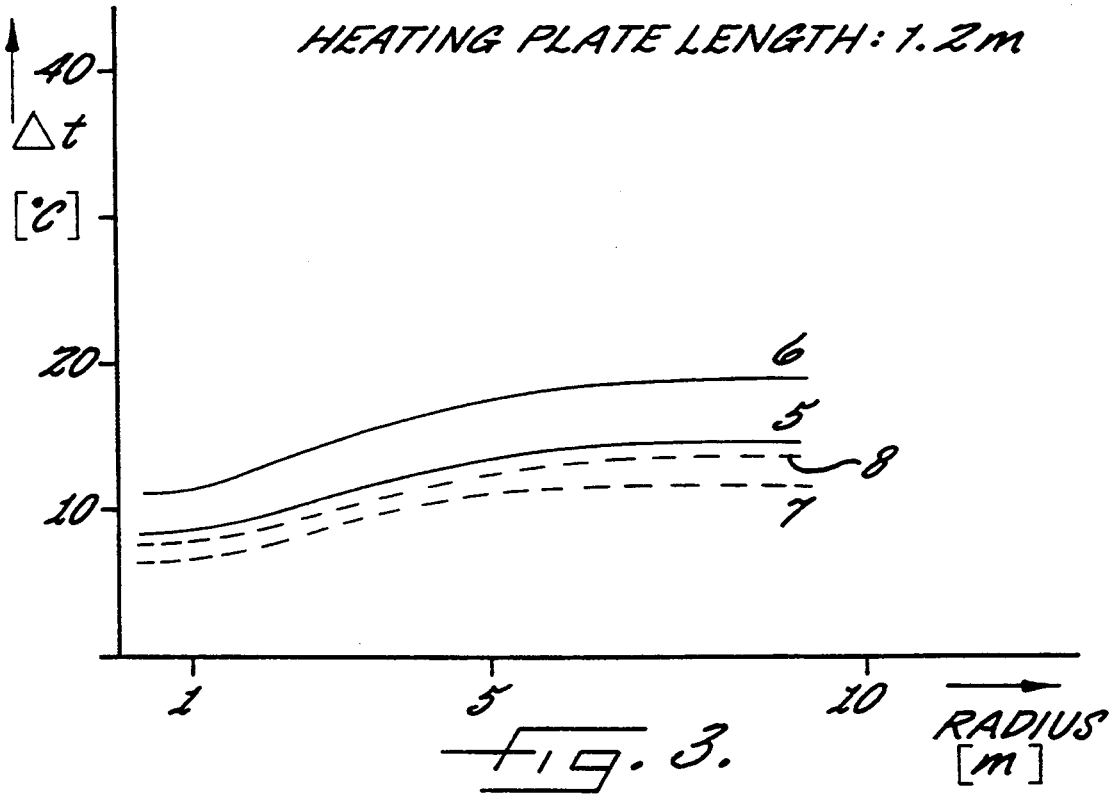

FIG. 3 illustrates the same interrelation for a polyamide yarn with a lower denier, wherein Curve 5: PA 66 44f13 dtex at 1000 m/min. and 220° C.;

Curve 6: PA 66 44f13 dtex at 1200 m/min. and 230° C.;

Curve 7: PA 66 22f7 dtex at 1100 m/min. and 220° C.; and

Curve 8: PA 66 22f7 dtex at 1300 m/min. and 230° C.

Based upon the foregoing one may conclude that ranges of curvature exist, in which the curvature of the heating plate has no significant effect on the heating. In the case of the polyester yarns of FIG. 2, such a range exists both with radii larger than 7 meters and with radii smaller than 1.50 meters. However, it should be noted that radii under 1.0 meter are hardly practicable due to a considerable buildup of friction. On the other hand, it can be derived from FIGS. 2 and 3 that the radius in any case should not be greater than about 8 meters.

In an intermediate range, however, the reduction of the radius permits the temperature difference between the heating plate and the yarn leaving the plate to be considerably lowered. One may therefore, reduce the length of the heating plate with impunity and yet stay within the range of temperature differences hitherto obtained on conventional equipment, assuming such temperature difference to be tolerable.

In the case of the yarns used in FIG. 3, which are easier to heat because of their lower denier and their composition, the dependent range, in which the temperature range or respectively the heating plate length, if the temperature difference is to remain within conventional limits may be reduced as the plate radius decreases, is less pronounced, but clearly noticeable.

FIG. 4 is a geometric illustration of several heating plates having different curvatures. The plate P is circular along its entire length, with a constant radius R and a length measured along the arc of chord L. The plate P1 has a greater curvature in its inlet region, which results in an intensive heat transfer to the yarn and thus a rapid heating in the inlet zone, and a length measured along the arc of chord L1 which is sufficient for making the yarn temperature uniform. The plate P2 has an opposite curvature and a length measured along the arc of chord L2, so as to adapt the increasing curvature of the heating plate to the increasing twist buildup in the advancing yarn.

In the drawings and specification, there has been set forth a preferred embodiment of the invention, and although specific terms are employed, they are used in a generic and descriptive sense only and not for purposes of limitation.

That which is claimed is:

1. A false twist yarn crimping apparatus comprising yarn package mounting means, an elongate yarn heating plate, an elongate yarn cooling plate, yarn friction false twisting means, yarn take-up means, and yarn delivery means for advancing a yarn from a package on said mounting means and serially to said heating plate, said cooling plate, said false twisting means, and said take-up means, said heating plate having a length measured between the ends of said heating plate and along a chord extending between the ends of said heating plate, a radius of curvature R at each point along the lengthwise extent of the heating plate, wherein L is between about 0.8 and about 2.2 meters, wherein R is between about 1 and about 8 meters, and wherein both R and L are chosen such that the ratio R/L is between about 0.8 and about 4.6.

2. The yarn false twisting apparatus as defined in claim 1 wherein said heating plate further has a looping angle alpha which is defined as the angle between a tangent at the entry end of said heating plate and a tangent at the exit end of said heating plate, and wherein R is of a substantially uniform value along the length of the heating plate and approximately equals $$\frac{L}{2\cos(\text{alpha}/2)}.$$

3. The yarn false twisting apparatus as apparatus as defined in claim 1 wherein said heating plate further has a looping angle alpha which is defined as the angle between a tangent at the entry end of said heating plate and a tangent at the exit end of said heating plate, and wherein the radius of curvature over the length of the heating plate varies between a theoretical value approximately equaling $$\frac{L}{2\cos(\text{alpha}/2)}$$

and a value less than said theoretical value.

4. The yarn false twisting apparatus as defined in claim 3 wherein the radius of curvature at the entry end of said heating plate is different from the radius of curvature at the exit end of said heating plate.

5. The yarn false twisting apparatus as defined in claim 1 wherein said yarn delivery means comprises a first yarn delivery means positioned between said yarn package mounting means and said yarn heating plate, and second yarn delivery means positioned between said yarn false twisting means and said yarn take-up means, and with the operational speed of said first and second yarn delivery means being controllable to permit the yarn to be drawn therebetween.

6. A method of false twist crimping a yarn and comprising the steps of providing a yarn false twisting apparatus comprising yarn package mounting means, an elongate yarn heating plate, an elongate yarn cooling plate, yarn friction false twisting means, and yarn take-up means, said heating plate having a radius of curvature R at each point along the lengthwise extent of the heating plate, and a length L measured between the ends of said heating plate and along a chord extending between the ends of said heating plate, and wherein L is between about 0.8 and about 1.6 meters, and the ratio R/L is between about 0.8 and about 4.4, and advancing a polyamide yarn from a package mounted on said mounting means serially to said heating plate, said cooling plate, said friction false twisting means, and said take-up means so as to effect the false twist crimping thereof and for producing a denier between about 15 to about 44 dtex.

7. The method as defined in claim 6 comprising the further step of drawing the yarn while effecting the false twist crimping thereof.

8. A method of false twist crimping a yarn comprising the steps of providing a yarn false twisting apparatus comprising yarn package mounting means, an elongate yarn heating plate, an elongate yarn cooling plate, yarn friction false twisting means, and yarn take-up means, said heating plate having a radius of curvature R at each point along the lengthwise extent of the heating plate, and a length L measured between the ends of said heating plate and along a chord extending between the ends of said heating plate, and wherein L is between about 1.6 and about 2.2 meters, and the ratio R/L is between about 0.8 and about 3.2, and advancing a polyester yarn from a package mounted on said mounting means serially to said heating plate, said cooling plate, said friction false twisting means, and said take-up means so as to effect the false twist crimping thereof and for producing a denier between about 55 to about 50 dtex.

9. The method as defined in claim 8 comprising the further step of drawing the yarn while effecting the false twist crimping thereof.

10. The method as defined in claim 8 wherein L is not greater than 2 meters, and R/L is less than 2.

* * * * *